US007623084B2

(12) United States Patent
Hoferer

(10) Patent No.: US 7,623,084 B2
(45) Date of Patent: Nov. 24, 2009

(54) ANGULAR DIVERSITY ANTENNA SYSTEM AND FEED ASSEMBLY FOR SAME

(75) Inventor: Robert A. Hoferer, Longview, TX (US)

(73) Assignee: General Dynamics C4 Systems, Inc., Scottsdale, AZ (US)

( * ) Notice: Subject to any disclaimer, the term of this patent is extended or adjusted under 35 U.S.C. 154(b) by 639 days.

(21) Appl. No.: 11/519,604

(22) Filed: Sep. 12, 2006

(65) Prior Publication Data

US 2008/0062056 A1 Mar. 13, 2008

(51) Int. Cl.
*H01Q 13/00* (2006.01)

(52) U.S. Cl. ..... 343/776; 343/779

(58) Field of Classification Search ..... 343/776, 343/779, 878, 884
See application file for complete search history.

(56) References Cited

U.S. PATENT DOCUMENTS 2,956,276 A * 10/1960 Friis ..... 342/361
2,956,277 A * 10/1960 Crawford ..... 342/361
4,253,193 A 2/1981 Kennard et al.
4,564,935 A 1/1986 Kaplan
4,777,491 A 10/1988 Bassi et al.
4,794,400 A 12/1988 Campora et al.

* cited by examiner

*Primary Examiner*—Shih-Chao Chen
(74) *Attorney, Agent, or Firm*—Meschkow & Gresham, PLC

(57) ABSTRACT

A feed assembly (26) for an antenna system (38) includes a first feed element (30) that propagates a first beam (32) and a second feed element (34) that propagates a second beam (36). The second feed element (34) is collocated with, but displaced vertically from, the first feed element (30) to achieve angular diversity in elevation. Each of the feed elements (30, 34) has an elongated conical shape and is formed from a dielectric material. The feed assembly (26) operates within the Ku-band frequency range to yield high gain, collimated, independent first and second beams (32, 36). The feed assembly (26) can be implemented in a tropospheric scatter communication system (38) in conjunction with a reflector (22) to provide concurrent transmit and receive capability via the two independent, angularly separated first and second beams (32, 36).

26 Claims, 4 Drawing Sheets

ANGULAR DIVERSITY ANTENNA SYSTEM AND FEED ASSEMBLY FOR SAME

TECHNICAL FIELD OF THE INVENTION

The present invention relates to the field of communication systems. More specifically, the present invention relates to a tropospheric scatter communication system having angular diversity.

BACKGROUND OF THE INVENTION

It is known that radio waves transmitted towards the horizon can be weakly received beyond the horizon due to an apparent reflective/diffractive nature of the troposphere. The troposphere is the layer of the earth's atmosphere from the ground to a height of approximately eight to ten kilometers (twenty-six thousand to thirty-two thousand feet). The scattering of radio waves off the troposphere, known as tropospheric scatter or troposcatter, has been utilized for commercial applications, normally on frequencies above 500 MHz for over the horizon links, and for transportable/temporary military and strategic communication systems. Troposcatter is advantageous for remote telemetry, or other links where low to medium rate data needs to be carried. Where viable, troposcatter provides a means of communication that is less costly than using satellites.

In the troposphere, the atmosphere is in continuous motion, including cloud formation and other convective effects, and there is a large decrease in temperature with height in the atmospheric layer which creates laminar atmospheric structures. Notably, there is no ionization in the troposphere layer. The turbulent motion of the air in the troposphere creates vortices, eddies, and other "blobs" as well as the laminar regions, all of which are scattering sites for radio waves. Thus, a transmitter in a tropospheric scatter system launches a high power signal, most of which passes through the atmosphere into outer space. However, a small amount of the signal is scattered when is passes through the troposphere, and passes back to earth at a distant point.

Troposcatter communication links transmit a collimated beam and receive the weakly scattered troposcatter signal beyond the horizon. Both sides of a link typically utilize the same antennas and are generally positioned to produce the same scatter angle. The scatter angle is the angle between an initial beam of radio signal propagated from a transmit antenna and the scattered beam reaching a distant receive antenna.

Collimated beams are typically created using parabolic-shaped antenna reflectors. Although the beams are initially collimated, the beams inherently spread as they propagate forward. As a result, a beam does not illuminate a single point in the troposphere, but rather a sizable volume. Beams from both sides of the link (i.e., transmit and receive beams) are pointed so as to illuminate a common volume known as the scatter volume.

By appropriately collimating and pointing the transmit and receive beams, link lengths in troposcatter communication systems from about fifty kilometers to a practical maximum of seven hundred kilometers can be achieved. The signal strength at the receive end of a troposcatter link decreases exponentially with increasing beam elevation angle and the related increase in scatter angle. Therefore, troposcatter beams are normally pointed at or close to the horizon.

Due to both long- and short-term random tropospheric irregularities, rapid variations in received power from the scatter volume can result in signal "fades" by as much as twenty or more decibels. Deep fades can occur beyond the minimum threshold of the receiver causing a loss of signal and making the use of a troposcatter communication link unreliable. To combat signal fade, diversity techniques have been utilized. These diversity techniques include, for example, spatial diversity (receiving multiple versions of the transmitted signal that have followed a different propagation path), frequency diversity (receiving multiple versions of the same signal transmitted at different carrier frequencies), polarization diversity (receiving multiple versions of a transmitted signal via antennas with different polarization), angular diversity (receiving two independent signals separated by a diversity angle), time diversity (receiving multiple versions of the same signal being transmitted at different time instances), and combinations thereof.

Spatial diversity entails transmitting the same signal with two antennas appropriately spaced and directed and using two other antennas similarly arranged for reception. The antennas at each side are typically separated by at least one hundred wavelengths to sample different scatter volumes and thereby de-correlate signal fades. At the receive end, signal processing can then reconstruct the original signal based on the signals received at both receive antennas. Unfortunately, the use of two antennas (i.e., two feeds and two reflectors) at each side of a tropospheric link is undesirably costly, complex, time consuming to set up and point the antennas, and utilizes an undesirably large footprint. It would be desirable in many troposcatter applications, particularly military and non-permanent commercial systems, to have the same or better link performance using only one transportable movable antenna at each site, rather than the two needed in a spatial diversity application.

Angular diversity entails transmitting a signal in a single beam and equipping a receiving antenna with two feed horns in close proximity to one another in such a manner that the transmitted beam is received in two different directions forming the diversity angle and giving rise to two relatively independent signals. These independent signals can be combined or otherwise processed to produce a received signal of sufficiently high intensity or signal-to-noise ratio.

Angular diversity is used less than spatial diversity due to the problem of optimizing the diversity angle, which depends on the distance between the two receiving feeds. As the diversity angle increases so does the statistical independence between the intensity fadings which appear on the two received signals, with a resulting system improvement. Unfortunately, antenna gain is simultaneously reduced because of defocusing at large diversity angles. Consequently, angular diversity with large diversity angles has only been practical with large diameter antenna reflectors (for example, greater than ten feet) in order to provide sufficient gain and other radio frequency properties.

Some attempts have been made to position two discrete feeds as close together as possible near the focal point of the antenna reflector so as to utilize angular diversity with smaller diameter antenna reflectors (for example, less than ten feed). Unfortunately, relatively high coupling loss between the antenna reflector and the feeds and other distortions result because the dual feeds must compromise their horn design in order to fit within the focal point of the antenna reflector. That is, feed assemblies should ideally have conical or corrugated feed horns. However, such large diameter conical or corrugated feed horns grossly overlap each other when positioned at the focal point of the antenna reflector. Consequently, compromises must be made in the size and shape of the feed horns that result in significant coupling losses and other issues.

Accordingly, what is needed is a feed assembly for an antenna system, such as, a tropospheric scatter communication system, that that employs angular diversity, and a dual-beam feed assembly for same that provides a high degree of isolation between beams.

SUMMARY OF THE INVENTION

Accordingly, it is an advantage of the present invention that a feed assembly for an antenna system is provided.

It is another advantage of the present invention that a dual-beam feed assembly is provided that achieves angular diversity in an antenna system without performance compromise.

Another advantage of the present invention is that a dual-beam feed assembly is provided that enables a tropospheric scatter system to be implemented as a cost effective, transportable, and readily deployable system.

The above and other advantages of the present invention are carried out in one form by a feed assembly for an antenna system. The feed assembly includes a first feed element exhibiting an elongated conical shape having a first apex and a first aperture at the first apex. The first feed element propagates a first beam. A second feed element is collocated with the first feed element, the second feed element exhibiting the elongated conical shape having a second apex and a second aperture at the second apex. The second feed element propagates a second beam, and the first and second beams are substantially non-overlapping.

The above and other advantages of the present invention are carried out in another form by a tropospheric scatter communication system having angular diversity. The tropospheric scatter communication system includes a reflector and a feed assembly in communication with the reflector. The feed assembly includes a first feed element exhibiting an elongated conical shape having a first apex and a first aperture at the first apex. The first feed element propagates a first beam over a Ku-band toward the reflector. A second feed element is collocated with the first feed element. The second feed element exhibits the elongated conical shape having a second apex and a second aperture at the second apex. The second feed element propagates a second beam over the Ku-band toward the reflector. The first and second beams are substantially non-overlapping.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

The present invention entails a dual-beam feed assembly for an antenna system. In a preferred embodiment, the dual-beam feed assembly is utilized in a tropospheric scatter communication system to provide angular diversity. However, the dual-beam feed assembly described herein may alternatively be used for line of sight (LOS) applications and/or satellite communication (satcom) links. Furthermore, the dual-beam feed assembly is described in connection with a parabolic reflector antenna system. However, the dual-beam feed assembly may alternatively be utilized in connection with other antenna systems, such as a parabolic torus antenna system, a spherical antenna system, a ring focus antenna system, and the like.

Figure 1:
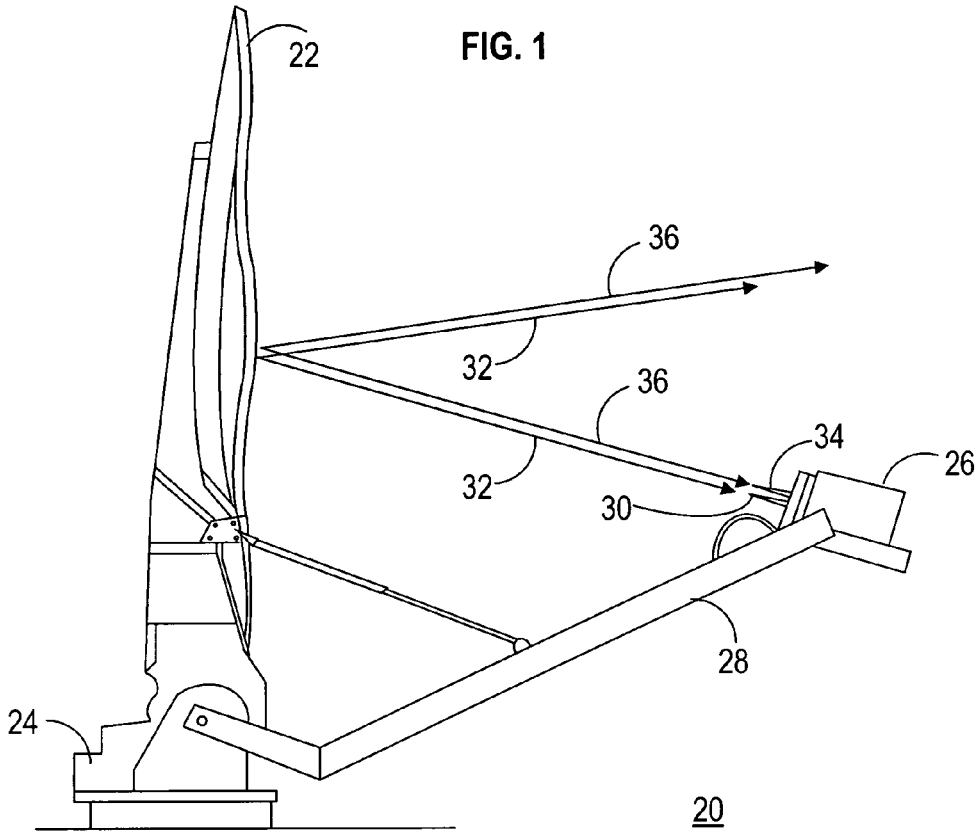
FIG. 1 shows a side view of a troposcatter station in accordance with a preferred embodiment of the present invention.

FIG. 1 shows a side view of a troposcatter station 20 in accordance with a preferred embodiment of the present invention. Troposcatter station 20 includes an antenna reflector 22 mounted on a positioning system 24. A feed assembly 26 is in communication with reflector 22. In particular, feed assembly 26 is coupled to positioning system 24 via a support structure 28. Troposcatter station 20 may be a readily transportable system configured for transmit and receive operations in C-, X-, Ku-, and Ka-bands. Reflector 22 is desirably a small, parabolic-shaped reflector having an approximately 2.4 meter (8 foot) diameter. Such a troposcatter station 20 having reflector 22 is readily transported and deployed in a variety of environmental conditions, is rugged, and is relatively low cost, these characteristics being attractive for both commercial and military markets.

In accordance with the present invention, feed assembly 26 is a dual-beam feed assembly that employs an angular diversity technique. In particular, feed assembly 26 includes a first feed element 30 for propagating a first collimated beam 32, and a second feed element 34 collocated with first feed element 30 for propagating a second beam 36. That is, first and second feed elements 30 and 34, respectively, are positioned as close together as possible proximate a focal point of reflector 22. Feed assembly 26 is connected to the associated radio-frequency (RF) transmitting or receiving equipment (not shown) by means of a conventional coaxial cable transmission line or hollow waveguide (not visible).

Each of first and second feed elements 30 and 34, respectively, can be configured to receive and/or transmit. When transmitting from first feed element 30, first beam 32, i.e. the radiation from first feed element 30, propagates toward reflector 22 where it in turn is re-radiated in a desired direction. Likewise, when transmitting from second feed element 34, second beam 36, i.e., the radiation from second feed element 34, propagates toward reflector 22 where it is also re-radiated in a desired direction. When receiving at first feed element 30, first beam 32 is received at reflector 22 where it is focused and re-radiated toward first feed element 30. Likewise, when receiving at second feed element 34, second beam 36 is received at reflector 22 where it is focused and re-radiated toward second feed element 34.

In a preferred embodiment, first and second feed elements 30 and 34 concurrently propagate respective first and second beams 32 and 36 in a common frequency band, and more specifically in the Ku-band (in the microwave range of frequencies from 12 to 18 GHz). Operation at Ku-band frequencies, such as the 14.9 to 15.4 GHz portion of the Ku-band frequency range provides a desirably narrow beamwidth (discussed below), high antenna gain, and can efficiently illuminate antenna reflector 22 having the relatively small, i.e., approximately 2.4 meter (8 foot) diameter.

Figure 2:
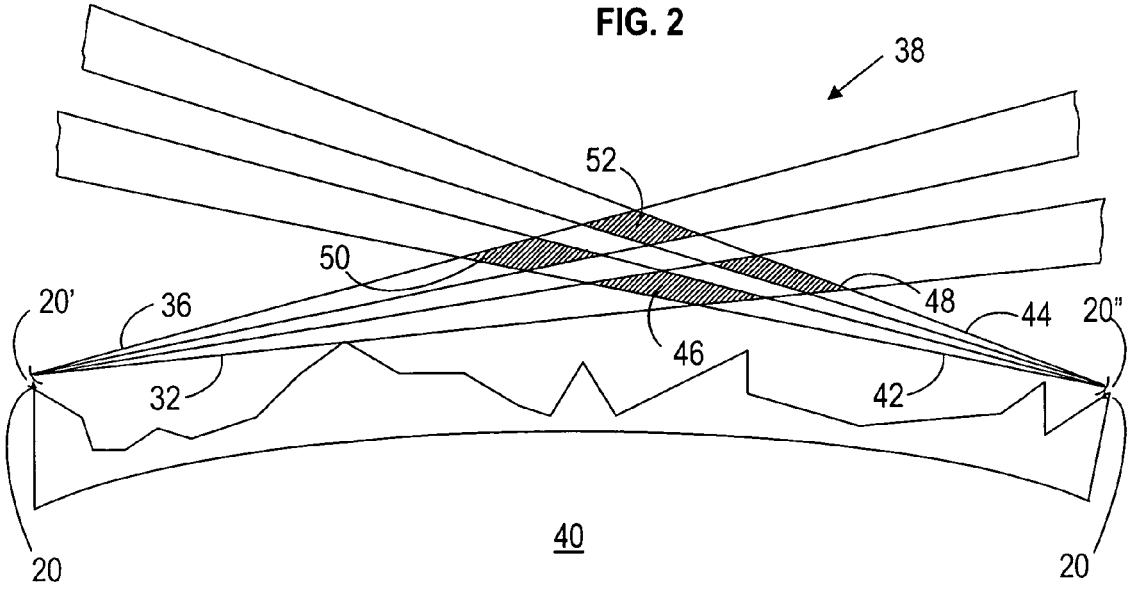
FIG. 2 shows a schematic illustration of a tropospheric scatter communication system utilizing two of the troposcatter stations of FIG. 1.

FIG. 2 shows a schematic illustration of a tropospheric scatter communication system 38 utilizing two of troposcatter stations 20, distinguished as a first troposcatter station 20' and a second troposcatter station 20". First troposcatter station 20' and second troposcatter station 20" are deployed in an environment 40 in an over-the-horizon configuration in which first and second troposcatter stations 20' and 20", respectively, cannot establish links via line-of-sight propagation, but can instead establish links using tropospheric scattering.

First troposcatter station 20' propagates first beam 32 and second beam 36. Second troposcatter station 20" propagates a third beam 42 and a fourth beam 44 via its corresponding first and second feed elements 30 and 34, respectively (FIG. 1). An intersection of first beam 32 with third and fourth beams 42 and 44, respectively, forms two common volumes, namely a first scatter volume 46 and a second scatter volume 48. Likewise, an intersection of second beam 36 with third and fourth beams 42 and 44, respectively, creates forms two additional common volumes, namely a third scatter volume 50 and a fourth scatter volume 52. First, second, third, and fourth scatter volumes 46, 48, 50, and 52 yield four distinct signal paths between first and second troposcatter stations 20' and 20". When a signal is received suitable signal processing may be utilized to select the best signal from first, second, third, and fourth scatter volumes 46, 48, 50, and 52. The opportunity to select from up to four separate signal paths greatly increases the reliability of a troposcatter link of system 38 since the probability is low that all four of first, second, third, and fourth scatter volumes 46, 48, 50, and 52 at any given time will all experience a deep (critical) fade.

Figure 3:
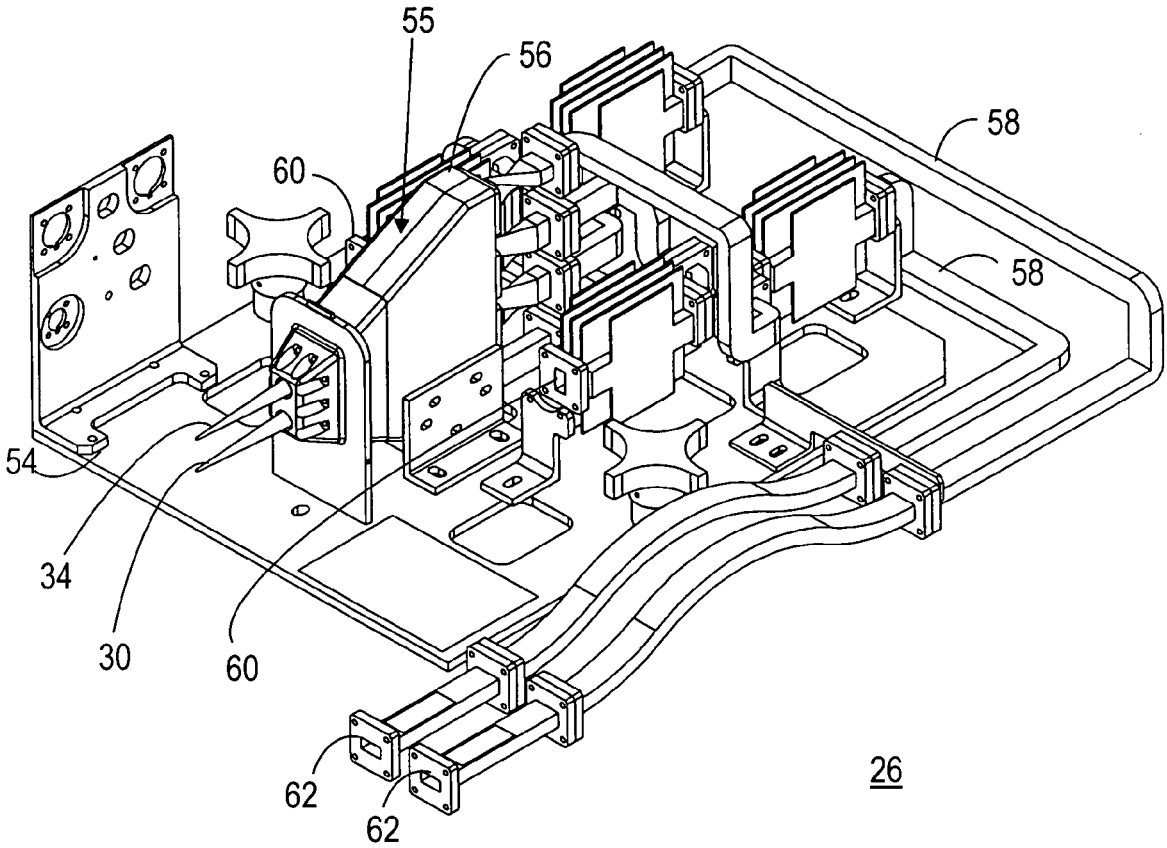
FIG. 3 shows a perspective view of a feed assembly for the troposcatter station of FIG. 1.

FIG. 3 shows a perspective view of feed assembly 26 for troposcatter station 20 (FIG. 1). Feed assembly 26 includes a base plate 54 that can be readily fixed to support structure 28 (FIG. 1). A feed head 55 is mounted to base plate 54. In general, feed head 55 includes first and second feed elements 30 and 34, respectively, each of which is in communication with an orthomode transducer (described below) housed in an orthomode transducer (OMT) block assembly 56. The orthomode transducers of OMT block assembly 56 are, in turn, in communication with waveguides 58 for conveying radio waves received at first and second feed elements 30 and 34 or for conveying radio waves to be transmitted from first and second feed elements 30 and 34.

In an exemplary embodiment, two ports of waveguides 58 are configured as receive ports 60. Receive ports 60 may be in communication with a downconverter (not shown) or a low-noise amplifier (not shown) as known to those skilled in the art. Additionally, two ports of waveguides 58 are configured as transmit ports 62 in the exemplary embodiment. Transmit ports 62 may be in communication with a high power amplifier (not shown) also as known to those skilled in the art. It will become apparent throughout the ensuing discussion that feed assembly 26 need not be configured with two receive ports 60 and two transmit ports 62, as specified above, but can be variously set up per specific communication constraints.

Figure 4:
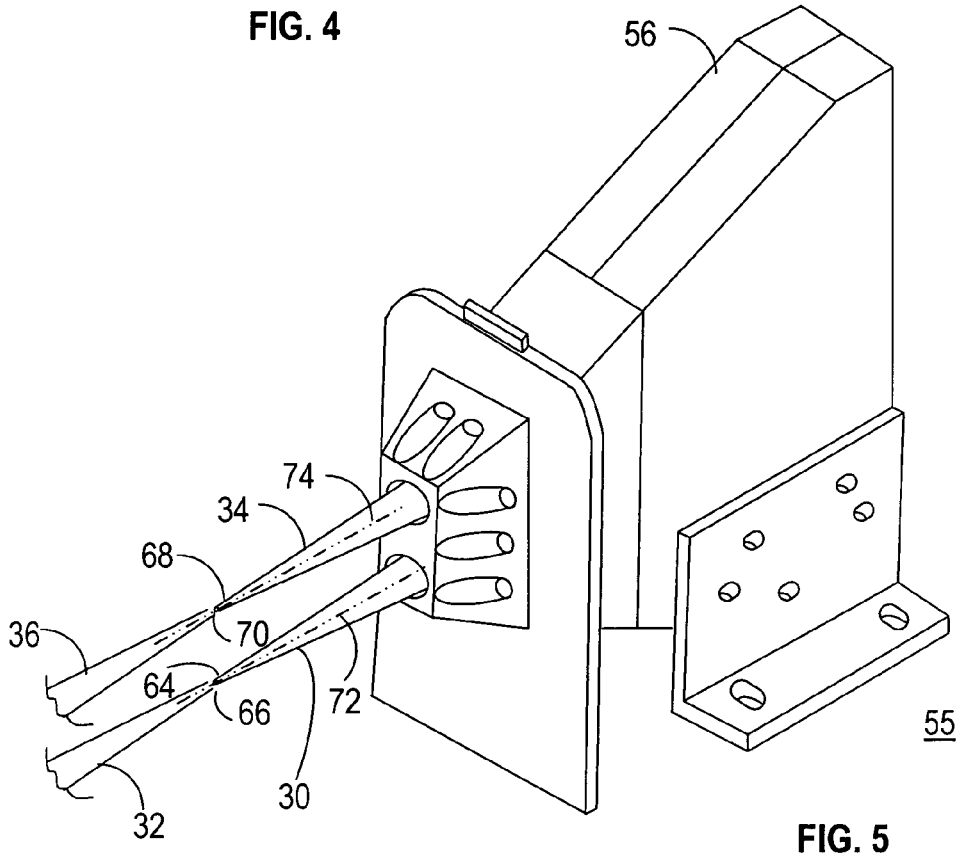
FIG. 4 shows a perspective view of a feed head of the feed assembly of FIG. 3.

FIG. 4 shows a perspective view of feed head 55 of feed assembly 26 (FIG. 3). As mentioned above feed head 55 includes first and second feed elements 30 and 34, respectively, and OMT block assembly 56. First feed and second feed elements 30 and 34 exhibit an elongated conical shape. First feed element 30 has a first apex 64 and a first aperture 66 at first apex 64 from which first beam 32 propagates. Similarly, second feed element 34 has a second apex 68 and a second aperture 70 at second apex 68 from which second beam 36 propagates.

In a preferred embodiment, feed head 55 is arranged vertically in troposcatter station 20 (FIG. 1) such that second feed element 34 is vertically displaced from first feed element 30. As known to those skilled in the art, angular diversity can be used in either the horizontal direction or vertical direction. Vertical displacement of first and second feed elements 30 and 34 is preferred because the level of de-correlation between common scatter volumes is typically greater than in the case of horizontal displacement of feed elements. However, horizontal displacement of first and second feed elements 30 and 34, respectively, may be implemented in lieu of vertical displacement in an alternative embodiment.

A first longitudinal axis 72 of first feed element 30 is arranged substantially parallel to a second longitudinal axis 74 of second feed element 34. Parallel alignment of first and second feed elements 30 and 34, respectively, preferably yields optimal illumination of antenna reflector 22 (FIG. 1) by first and second feed elements 30 and 34, respectively, without inadvertently introducing angular diversity in the horizontal direction.

Figure 5:
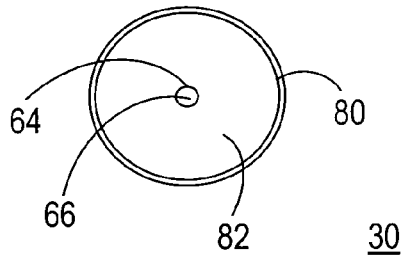
FIG. 5 shows an end view of a feed element of the feed head of FIG. 4.
Figure 6:
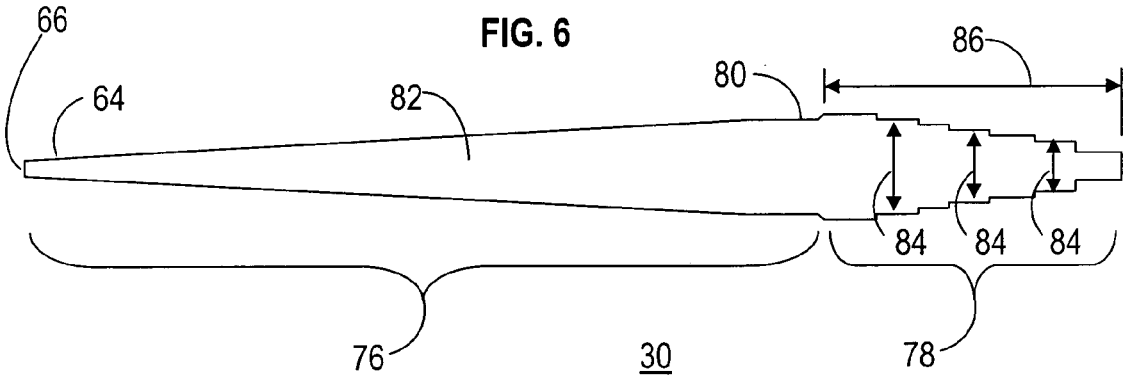
FIG. 6 shows a side view of the feed element of FIG. 5.

Referring to FIGS. 5-6, FIG. 5 shows an end view of first feed element 30 of feed head 55 (FIG. 4), and FIG. 6 shows a side view of first feed element 30. First and second feed elements 30 and 34 are largely identical. As such, the following description of first feed element 30 applies equally to second feed element 34.

First feed element 30 includes a conical section 76 and a reducing section 78. Conical section 76 includes first apex 66, a base 80, and an outer surface 82 spanning between and uniformly tapering from base 80 to first apex 66. Conical section 76 is shaped as a right circular cone in which base 80 is a circle and first apex 66 is on a line perpendicular to the plane containing base 80.

Reducing section 78 is coupled to and extends away from base 80. In addition, reducing section 78 is longitudinally aligned with conical section 76. As particularly illustrated in FIG. 6, reducing section 78 exhibits a stepwise reduction of a cross-section dimension 84 along a length 86 of reducing section 78 moving away from base 80.

Each of first and second feed elements 30 and 34, respectively, is formed as a conical solid from a dielectric material. In a preferred embodiment, the dielectric material is fused silica (fused quartz) that has an appropriate dielectric constant, is durable, and can be readily shaped into conical section 76 with high precision. The dielectric material acts as a radiating element with high directivity preventing first beam 32 (FIG. 4) from coupling forward or backward into the path of second beam 36, and vice versa. Additionally, the selection of fused silica allows for the construction of a feed element of practical size and strength, while efficiently illuminating antenna reflector 22 (FIG. 1). Fused silica also has the unique properties of having a very low coefficient of thermal expansion and low Ohmic losses in the Ku-band frequency range. Although the use of fused silica is preferred, it should be understood that other dielectric materials may also be suitable.

Several features of first feed element 30 optimize first beam 32. These features include the uniform tapering of conical section 76, the presence of reducing section 78 for providing a transformation region from air in the rectangular orthomode transducers (discussed below) of OMT block assembly 56 (FIG. 4) to the circular solid of conical section 76, and the use of fused silica with its particular dielectric constant. These features yield first feed element 30 that is durable, elongated, and has an optimally-sized, i.e., minimized, first aperture 66 capable of propagating first beam 32 having the desired radiation characteristics of narrow bandwidth, high antenna gain, and efficient illumination of antenna reflector 22 (FIG. 1). These same features in second feed element 34 (FIG. 4) also yield second feed element 34 that is durable, elongated, and has an optimally-sized, i.e., minimized, second aperture 70 (FIG. 4) capable of propagating second beam 36 having the desired radiation characteristics of narrow bandwidth, high antenna gain, and efficient illumination of antenna reflector 22 (FIG. 1).

The desired length and taper of each of first and second feed elements 30 and 34, respectively, may be optimized by modeling software known to those skilled in the art in order to tailor the illumination of a particular antenna reflector, such as the 2.4 meter (8 foot) antenna reflector 22 mentioned herein. Such modeling software can be used to calculate individual feed element characteristics, return loss, radiation characteristics, and so forth. Additional modeling software can then predict antenna patterns, gains, side lobes, and so forth.

The utilization of Ku-band frequencies results in a 3-dB beamwidth of approximately 0.6 degrees for each of first and second beams 32 and 36. As such the angle separation of first and second beams 32 and 36, respectively, is approximately 0.6 degrees in elevation. Constrained by the requirements of operating at Ku-band frequency (and the resulting 3-dB antenna beamwidth), the 2.4 meter (8 foot) size of antenna reflector 22, and the approximately 0.6 degrees of beam separation calls for the centers of first and second feed elements 30 and 34 to be within 2.3 cm (0.9 inches) of each other, and the length of each of first and second feed elements 30 and 34 to be approximately 20.3 cm (8 inches).

The approximately 0.6 degrees of angular separation between first and second beams 32 and 36, respectively, represents an optimal solution between de-correlating the scattering of the four common volumes, i.e., scatter volumes 46, 48, 50, and 52 (FIG. 2) by minimizing overlap of volumes 46, 48, 50, and 52 and minimizing the scan loss of second beam 36 (FIG. 4). Scan loss is minimized by minimizing the angular separation between first and second beams 32 and 36, respectively, and aiming first beam 32 at or very near the radio horizon.

The shape of first and second feed elements 30 and 34, respectively, the material from which they are fabricated, and a desired operational frequency in the Ku-band yields first and second beams 32 and 36, respectively, that are substantially non-overlapping and highly independent. Consequently, first and second feed elements 30 and 34 are not two separate, compromised feed horns located close together. Rather, they represent an integrated design which places both of first and second feed elements 30 and 34 in approximately the same focal point with negligible performance compromise.

Figure 7:
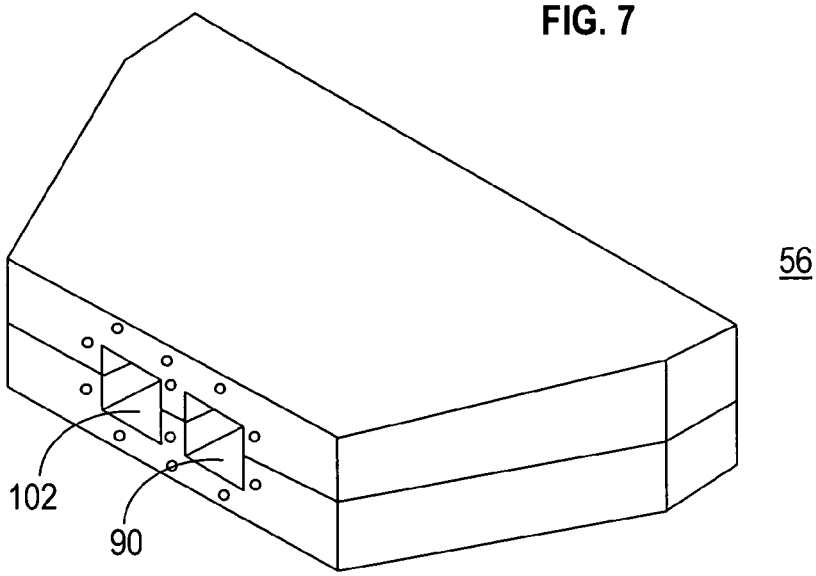
FIG. 7 shows a perspective view of an orthomode transducer block assembly of the feed assembly of FIG. 3.
Figure 8:
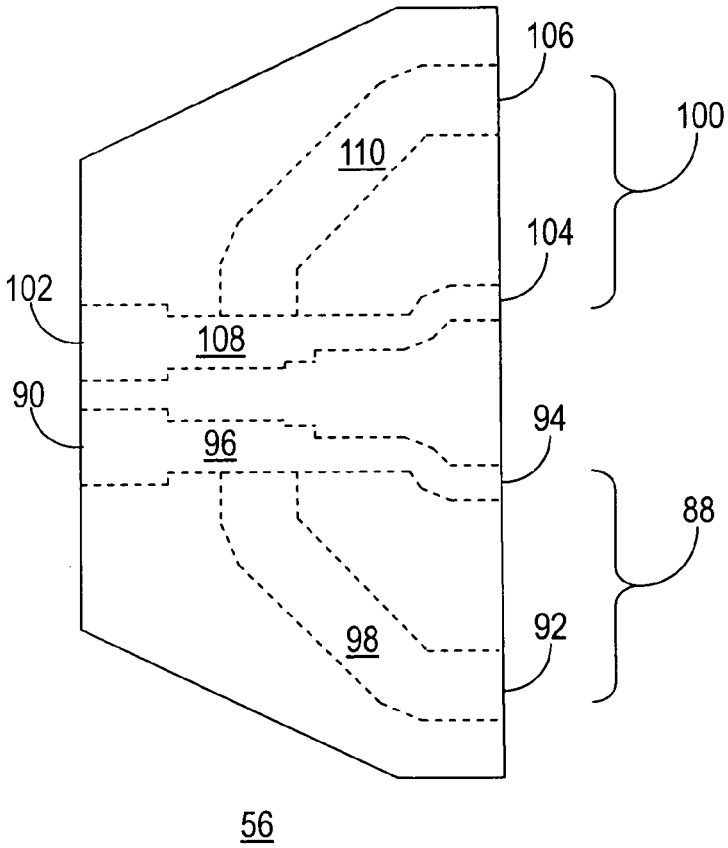
FIG. 8 shows a side view of the orthomode transducer block assembly.
Figure 9:
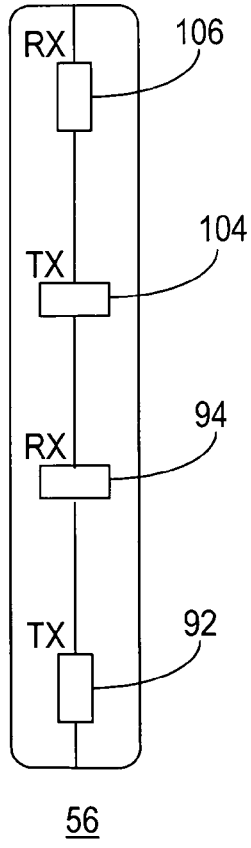
FIG. 9 shows a rear view of the orthomode transducer block assembly.

Referring to FIGS. 7-9, FIG. 7 shows a perspective view of orthomode transducer (OMT) block assembly 56 of feed assembly 26 (FIG. 3), FIG. 8 shows a side view of OMT block assembly 56, and FIG. 9 shows a rear view of OMT block assembly 56. Discrimination of first and second beams 32 and 34, respectively, may optionally be increased by polarizing one of first and second beams 32 and 34 vertically linear and the other horizontally linear. This polarization discrimination is achieved through the implementation of OMT block assembly 56.

OMT block assembly 56 includes a first orthomode transducer 88 having a first feed port 90. Reducing section 78 (FIG. 6) of first feed element 30 (FIG. 4) seats in first orthomode transducer 88 via first feed port 90. First orthomode transducer 88 further includes a first horizontal port 92 and a first vertical port 94. First vertical port 94 is in communication with first feed port 90 via a second passage 96, shown in ghost form. A first passage 98, also shown in ghost form, branches from second passage 96 such that first horizontal port 92 is also in communication with first feed port 90.

OMT block assembly further includes a second orthomode transducer 100 having a second feed port 102. Reducing section 78 of second feed element 34 (FIG. 4) seats in second orthomode transducer 100 via second feed port 102. Second orthomode transducer 100 further includes a second vertical port 104 and a second horizontal port 106. Second vertical port 104 is in communication with second feed port 102 via a third passage 108, shown in ghost form. A fourth passage 110, also shown in ghost form, branches from third passage 108 such that second horizontal port 106 is also in communication with second feed port 102.

Each of first and second orthomode transducers 88 and 100, respectively, of OMT block assembly 56 are waveguide orthomode transducers. Each of passages 96, 98, 108, and 110 are rectangular tubes through which radio waves propagate between corresponding first and second feed elements 30 and 34, respectively (FIG. 4), and waveguides 58 (FIG. 3). The radio waves passing through passages 96, 98, 108, and 110 are forced to follow the path determined by the physical structure of the guide. As shown, first passage 98 and corresponding first horizontal port 92 are oriented orthogonal to second passage 96 and corresponding first vertical port 94. Similarly, third passage 108 and corresponding second vertical port 104 are oriented orthogonal to fourth passage 110 and corresponding second horizontal port 106.

These dual passages in each of first and second orthomode transducers 88 and 100, respectively, function to combine or separate orthogonally polarized signals. That is, each of first and second orthomode transducers 88 and 100 has both a vertical and a horizontal port. Thus, the combination of first and second feed elements 30 and 34, respectively, with OMT block assembly 56 yields a four port type dual beam feed.

In an exemplary configuration, feed assembly 26 (FIG. 3) may be configured to have two receive ports and two transmit ports. For example, first horizontal port 92 may be configured as a transmit port and first vertical port 94 may be configured as a receive port for first beam 32 (FIG. 4) propagated at first feed element 30 (FIG. 4). Polarization discrimination can then be achieved by configuring second vertical port 104 as a transmit port and second horizontal port 106 as a receive port. In addition, feed assembly 26 is capable of concurrent reception and transmission of first and second beams 32 and 36, respectively. It should be understood however that the implementation of OMT block assembly 56 with first and second independent feed elements 30 and 34, respectively, yields a versatile system in which receive and transmit capability can be readily changed.

In summary, the present invention teaches of a dual-beam feed assembly for an antenna system that desirably operates at Ku-band frequencies and achieves angular diversity. The dual-beam feed assembly produces two concurrent beams in elevation to illuminate separate scatter volumes. The two feed elements of the dual-beam feed assembly have an elongated conical shape, are formed from a dielectric material, and are closely spaced with one another at the focal point of an antenna reflector. Operation at Ku-band frequencies, the shape of the feed elements, and the use of a dielectric material provides a desirably narrow beamwidth, high antenna gain, and efficiently illuminates existing transportable antenna reflectors. Utilization of the orthomode transducer block provides polarization discrimination (vertical and horizontal)

with high isolation, and produces a four port type dual beam feed that can readily be configured for concurrent receive and transmit functionality. The dual-beam feed assembly enables a tropospheric scatter system to be implemented as a cost effective, transportable, and readily deployable system without performance compromise.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A feed assembly for an antenna system comprising:

a first feed element exhibiting an elongated conical shape having a first apex and a first aperture at said first apex, said first feed element propagating a first beam; and a second feed element collocated with said first feed element, said second feed element exhibiting said elongated conical shape having a second apex and a second aperture at said second apex, said second feed element propagating a second beam, and said first and second beams being substantially non-overlapping.

2. A feed element as claimed in claim 1 wherein said first and second feed elements concurrently propagate said first and second beams over a common frequency band.

3. A feed element as claimed in claim 2 wherein said common frequency band is a Ku-band.

4. A feed assembly as claimed in claim 1 wherein each of said first and second feed elements are formed as a conic solid from a dielectric material.

5. A feed assembly as claimed in claim 4 wherein said dielectric material is fused silica.

6. A feed assembly as claimed in claim 1 wherein a first longitudinal axis of said first feed element is substantially parallel to a second longitudinal axis of said second feed element.

7. A feed assembly as claimed in claim 1 wherein said second feed element is vertically displaced from said first feed element.

8. A feed assembly as claimed in claim 1 wherein:

said first feed element comprises a first conical section including said first apex, a first base, and a first outer surface spanning between and uniformly tapering from said first base to said first apex; and said second feed element comprises a second conical section including said second apex, a second base, and a second outer surface spanning between and uniformly tapering from said base to said second apex.

9. A feed assembly as claimed in claim 8 wherein each of said first and second conical sections is shaped as a right circular cone.

10. A feed assembly as claimed in claim 1 wherein:

said first feed element includes a first conical section having a first base on an end opposing said first apex and a first reducing section coupled to and extending away from said first base; and said second feed element includes a second conical section having a second base on an end opposing said second apex and a second reducing section coupled to and extending away from said second base.

11. A feed assembly as claimed in claim 10 wherein each of said first and second reducing sections is longitudinally aligned with a corresponding one of said first and second conical sections.

12. A feed assembly as claimed in claim 10 wherein:

said first reducing section exhibits a stepwise reduction of a cross-section dimension along a length of said first reducing section moving away from said first base; and said second reducing section exhibits said stepwise reduction of said cross-section dimension along said length of said second reducing section moving away from said second base.

13. A feed assembly as claimed in claim 10 further comprising:

a first waveguide having a first port in communication with said first reducing section of said first feed element; and a second waveguide having a second port in communication with said second reducing section of said second feed element.

14. A feed assembly as claimed in claim 13 wherein each of said first and second waveguides comprises an orthomode transducer having a vertical polarization port and a horizontal polarization port.

15. A feed assembly as claimed in claim 1 wherein each of said first and second feed elements provides a corresponding one of said first and second beams having a 3 dB beamwidth of approximately 0.6 degrees.

16. A feed assembly as claimed in claim 1 wherein an angle of separation of said first and second beams is approximately 0.6 degrees in elevation.

17. A tropospheric scatter communication system having angular diversity comprising:

a reflector; and a feed assembly in communication with said reflector, said feed assembly including:

a first feed element exhibiting an elongated conical shape having a first apex and a first aperture at said first apex, said first feed element propagating a first beam over a Ku-band toward said reflector; and a second feed element collocated with said first feed element, said second feed element exhibiting said elongated conical shape having a second apex and a second aperture at said second apex, said second feed element propagating a second beam over said Ku-band toward said reflector, and said first and second beams being substantially non-overlapping.

18. A system as claimed in claim 17 wherein said reflector is a first reflector, said feed assembly is a first feed assembly, said first reflector and said first feed assembly form a first troposcatter station, and said system further comprises:

a second reflector; and a second feed assembly in communication with said first reflector to form a second troposcatter station located remote from said first troposcatter system, said second feed assembly including:

a third feed element exhibiting said elongated conical shape having a third apex and a third aperture at said third apex, said third feed element propagating a third beam over said Ku-band toward said second reflector; and a fourth feed element collocated with said third feed element, said fourth feed element exhibiting said elongated conical shape having a fourth apex and a fourth aperture at said fourth apex, said fourth feed element propagating a fourth beam over said Ku-band toward said second reflector, said third and fourth beams being substantially non-overlapping, wherein:

an intersection of said first beam with said third and fourth beams forms first and second scatter volumes;

an intersection of said second beam with said third and fourth beams forms third and fourth scatter volumes; and said first, second, third, and fourth scatter volumes form four distinct signal paths between said first and second stations.

19. A system as claimed in claim 18 wherein each of said first, second, third, and fourth feed elements comprises:

a reducing section extending from a base of said elongated conical shape; and a waveguide having a port in communication with said reducing section.

20. A system as claimed in claim 19 wherein said waveguide comprises an orthomode transducer having a vertical polarization port and a horizontal polarization port.

21. A feed assembly for an antenna system comprising:

a first feed element formed as a conic solid from a dielectric material, said first feed element including a first apex, a first base, and a first outer surface spanning between and uniformly tapering from said first base to said first apex, said first feed element having a first aperture at said first apex, said first feed element propagating a first beam; and a second feed element collocated with said first feed element, said second feed element formed as said conic solid from said dielectric material, said second feed element including a second apex, a second base, and a second outer surface spanning between and uniformly tapering from said second base to said second apex, said second feed element having a second aperture at said second apex, said second feed element propagating a second beam, and said first and second beams being substantially non-overlapping.

22. A feed assembly as claimed in claim 21 wherein said first and second feed elements concurrently propagate said first and second beams over a Ku-band.

23. A feed assembly as claimed in claim 21 wherein:

said first feed element includes a first base on an end opposing said first apex and a first reducing section coupled to and extending away from said first base; and said second feed element includes a second base on an end opposing said second apex and a second reducing section coupled to and extending away from said second base.

24. A feed assembly as claimed in claim 23 wherein:

said first reducing section exhibits a stepwise reduction of a cross-section dimension along a length of said first reducing section moving away from said first base; and said second reducing section exhibits said stepwise reduction of said cross-section dimension along said length of said second reducing section moving away from said second base.

25. A feed assembly as claimed in claim 23 further comprising:

a first waveguide having a first port in communication with said first reducing section of said first feed element; and a second waveguide having a second port in communication with said second reducing section of said second feed element.

26. A feed assembly as claimed in claim 25 wherein each of said first and second waveguides comprises an orthomode transducer having a vertical polarization port and a horizontal polarization port.

* * * * *